US010753691B1

(12) United States Patent
Williams et al.

(10) Patent No.: US 10,753,691 B1
(45) Date of Patent: Aug. 25, 2020

(54) LOCKING BLOCK AND SLIDE FOR FIREARM

(71) Applicants: Brian Williams, Hudson, FL (US); Tiffany Williams, Hudson, FL (US)

(72) Inventors: Brian Williams, Hudson, FL (US); Tiffany Williams, Hudson, FL (US)

( * ) Notice: Subject to any disclaimer, the term of this patent is extended or adjusted under 35 U.S.C. 154(b) by 0 days.

(21) Appl. No.: 16/246,466

(22) Filed: Jan. 12, 2019

(51) Int. Cl.
*F41A 3/66* (2006.01)
*F41A 21/48* (2006.01)

(52) U.S. Cl.
CPC ..... *F41A 3/66* (2013.01); *F41A 21/484* (2013.01); *F41A 21/488* (2013.01)

(58) Field of Classification Search
CPC ..... F41A 21/484; F41A 21/488
USPC ..... 42/16
See application file for complete search history.

(56) References Cited

U.S. PATENT DOCUMENTS 5,325,617 A * 7/1994 Vojta ..... F41A 11/02 42/75.03
5,741,996 A * 4/1998 Ruger ..... F41A 3/66 89/196
6,363,831 B2 * 4/2002 Gussalli Beretta ..... F41A 5/04 89/163
6,993,864 B1 * 2/2006 O'Clair ..... F41A 3/14 42/71.02
2013/0160341 A1 * 6/2013 Bubits ..... F41A 3/44 42/2
2017/0030673 A1 * 2/2017 Lee ..... F41A 11/00
2018/0306536 A1 * 10/2018 Ellis ..... F41A 3/36

* cited by examiner

*Primary Examiner* — Bret Hayes
(74) *Attorney, Agent, or Firm* — Gulf Coast Intellectual Property Group

(57) ABSTRACT

A firearm assembly including a receiver, a barrel, a locking block and a slide configured to provide rapid changing of a barrel of a handgun wherein the barrel may be for an alternate caliber round of ammunition. The locking block is configured to be secured within the receiver and includes an upper surface that has front rise member, a rear rise member and a valley intermediate thereto. The upper surface of the locking block is mateably shaped with the second portion of the barrel, in particular the lower portion thereof. The lower portion includes a front shoulder member, a rear shoulder member and a notch formed therebetween wherein the notch is configured to mateably engage the rear rise member of the locking block. The slide of the present invention includes a void intermediate the sidewall and the extractor housing. A shim is provided to be secured within the void.

6 Claims, 5 Drawing Sheets

LOCKING BLOCK AND SLIDE FOR FIREARM

PRIORITY UNDER 35 U.S.C SECTION 119(E) & 37 C.F.R. SECTION 1.78

This nonprovisional application claims priority based upon the following prior United States Provisional Patent Application entitled: Pinless Locking Block for Use with Semi-Automatic Firearm, Application No. 62/261,8048 filed Jan. 16, 2018, in the name of Brian Williams, which is hereby incorporated by reference for all purposes.

FIELD OF THE INVENTION

The present invention relates generally to firearms, more specifically but not by way of limitation, a locking block and barrel assembly that is configured to facilitate an improved ability to change a barrel on a firearm such as but not limited to a semi-automatic handgun. Furthermore, the present invention provides a slide construction operable to accommodate different caliber ammunition and facilitate engagement thereof with the extractor pin.

BACKGROUND

Semi-automatic handguns are manufactured in numerous alternate styles and calibers. As is known in the art, semi-automatic handguns include a couple of key elements that include but are not limited to a receiver, a barrel, an upper slide. During the firing process the slide traverses initially in a rearward direction immediately subsequent firing of a round of ammunition. The slide is configured with an ejection port that permits the spent casing to be ejected and upon ejection of the spent casing a new round of ammunition is pushed upward into the chamber wherein the new round is loaded into the firing position as the slide moves in a forward direction.

There are numerous construction techniques that connect the receiver of a semi-automatic handgun to the barrel. Pivotal connection members such as those found in the Colt model 1911 are well known in the art. One problem with connection members such as the aforementioned is the reduced structural integrity of the member. Additionally, these connection members are secured within the firearm utilizing multiple pins. The utilization of multiple pins and/or points of removal to change a barrel creates a slow and cumbersome process for a user to have the ability to replace the barrel and/or change the barrel for another caliber. Furthermore, conventional slide construction will not accommodate alternate caliber rounds and in particular if a barrel is changed to configure a firearm to fire ammunition having a different diameter, the conventional slide configuration will inhibit effective engagement of both ammunition casings by the extractor pin.

Accordingly, there is a need for locking block and barrel assembly that provides an improved connection between the barrel of a firearm and the receiver wherein the assembly further facilitates the rapid exchange of a barrel. Furthermore, an alternate slide construction is provided therewith so as to ensure effective engagement of the extractor pin and alternate sizes of ammunition.

SUMMARY OF THE INVENTION

It is the object of the present invention to provide a locking block and barrel assembly for a firearm wherein the locking block provides a structural and operable connection intermediate the barrel of the firearm and the receiver.

Another object of the present invention is to provide an improved firearm configured to effectively discharge alternate sizes of ammunition wherein the slide of the present invention is configured to assist in the engagement of the ammunition shells of alternate sizes and the extractor pin of the firearm.

A further object of the present invention is to provide a locking block and barrel assembly for a firearm that is configured to facilitate rapid changing of the barrel of the firearm wherein the barrel includes a first portion and a second portion.

Still another object of the present invention is to provide a locking block and barrel assembly for a firearm wherein the second portion of the barrel is integrally formed with the first portion and wherein the second portion is constructed to mateably coupled with the locking block.

An additional object of the present invention is to provide an improved firearm configured to effectively discharge alternate sizes of ammunition wherein the slide of the present invention includes a void formed adjacent the extractor assembly.

Yet a further object of the present invention is to provide a locking block and barrel assembly for a firearm that is configured to facilitate rapid changing of the barrel of the firearm wherein the locking block includes a shoulder and notch configuration on the upper surface thereof that is mateably shaped with the second portion of the barrel of the present invention.

Another object of the present invention is to provide an improved firearm configured to effectively discharge alternate sizes of ammunition wherein the slide of the present invention includes a removable shim releasably secured in the void and wherein the removable shim is provided in alternate thicknesses.

Still a further object of the present invention is to provide a locking block and barrel assembly for a firearm that is configured to facilitate rapid changing of the barrel of the firearm wherein the locking block includes an aperture bored therethrough so as to receive a pin for securing thereof.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
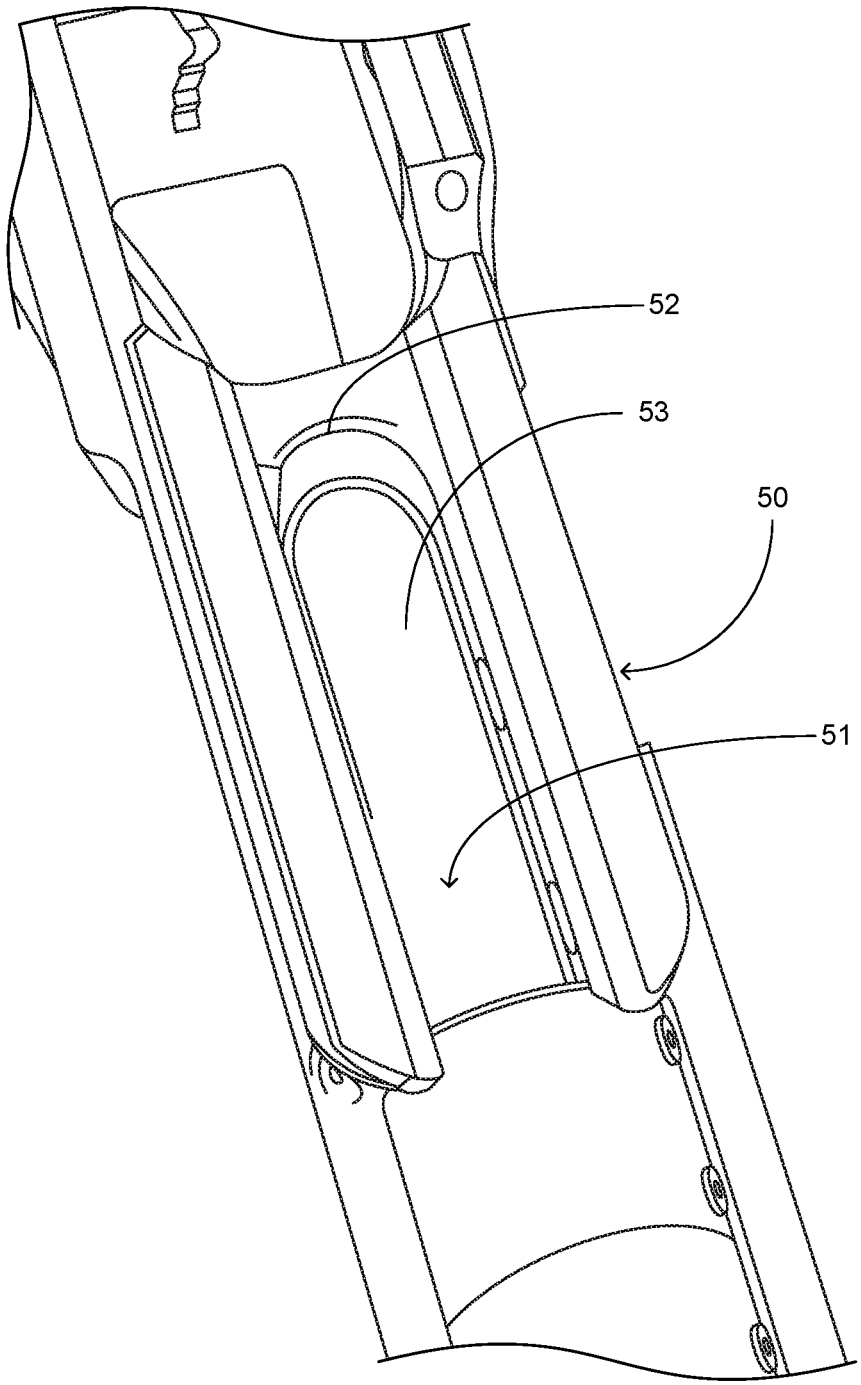
FIG. 1 is a top perspective view of a portion of the receiver of the firearm.

Referring now to the drawings submitted herewith, wherein various elements depicted therein are not necessarily drawn to scale and wherein through the views and figures like elements are referenced with identical reference numerals, there is illustrated a locking block and barrel assembly 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith the locking block and barrel assembly 100 includes barrel 10. The barrel 10 includes a first portion 12 and a second portion 14 wherein the first portion 12 and second portion 14 are integrally formed utilizing suitable durable techniques. The first portion 12 is manufactured similarly to conventional firearm barrels wherein the first portion 12 can be cylindrical in shape and includes a rifled bore passing therethrough (not illustrated herein). The first portion 12 includes end 13 wherein end 13 is the point of discharge for a fired round of ammunition. While the first portion 12 is illustrated herein as having a particular exterior shape, it is contemplated within the scope of the present invention that the first portion 12 could have alternate exterior shapes and further be manufactured in various lengths and calibers.

Figure 5:
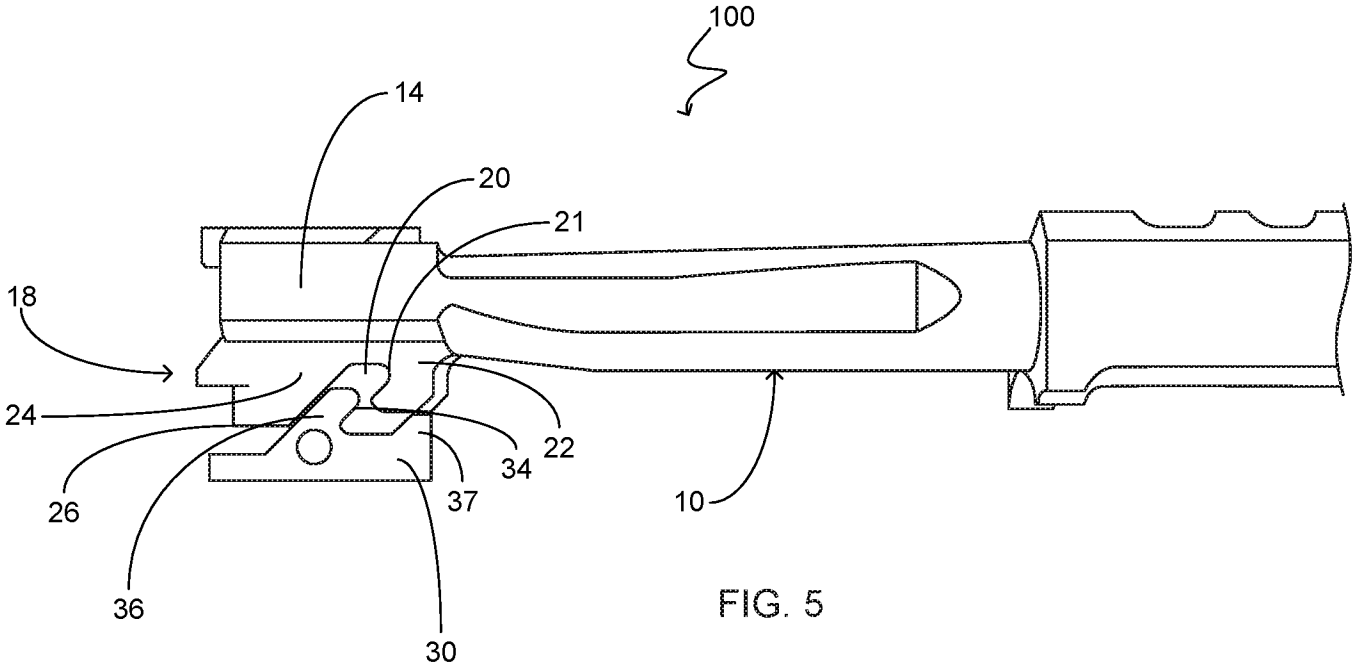
FIG. 5 is a detailed view of the locking block and barrel assembly of the present invention removed from the firearm.

The second portion 14 of the barrel 10 is formed to have a lower portion 18 that is mateably shaped to operably coupled with the locking block 30 of the present invention. The lower portion 18 includes a notch 20 bordered on opposing sides thereof by a front shoulder member 22 and rear shoulder member 24. Notch 20 further includes indentation 21 that is shaped and configured to mateably engage protrusion 37. The front shoulder 22 is manufactured so as to extend downward at a distance that is less than that of the downward extension of the rear shoulder member 24. The rear shoulder member 24 includes lower rear wall 26 that is configured to impact receiver wall 52 during the firing process. FIG. 5 illustrates the operable coupling between the second portion 14 of the barrel 10 and the locking block 30. When completely assembled in the firearm and during a firing of a round of ammunition, the lower rear wall 26 of the second portion 14 will engage the receiver wall 52. The locking block 30 is machined to a size such that the rear edge wall 31 thereof is axially aligned with the lower rear wall 26 at the end of the midpoint of the firing cycle wherein the slide 60 has traversed completely rearward. The design facilitates the majority of the impact force being absorbed by the lower rear wall 26 of the second portion 14 of the barrel 10 and as such reduces the force on the locking block 30. This reduced force on the locking block 30 increases the durability of the operable connection that the locking block 30 provides intermediate the receiver 50 and the barrel 10.

Figure 2:
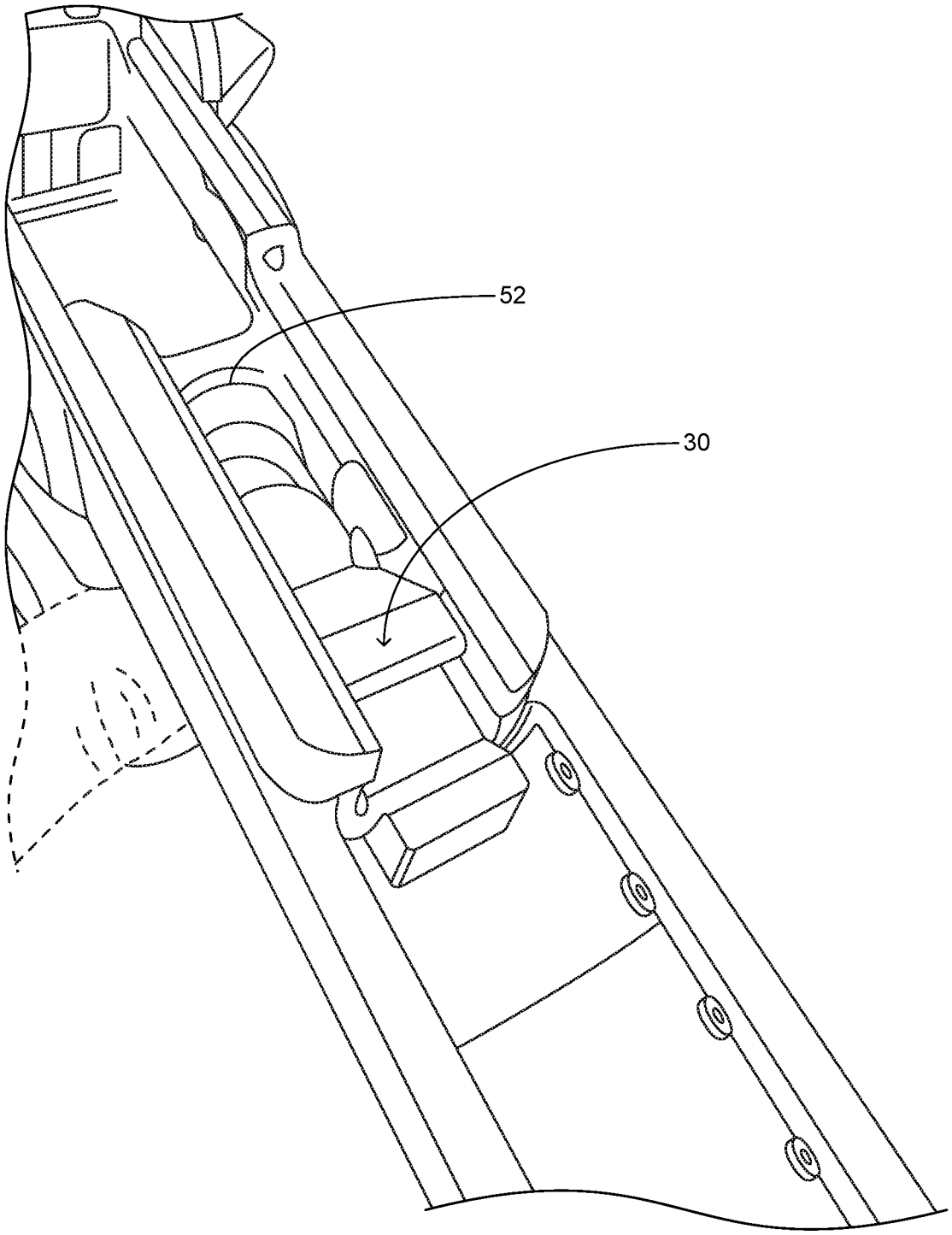
FIG. 2 is a top perspective view of a portion of the receiver of the firearm with the locking block disposed in the cavity thereof.
Figure 3:
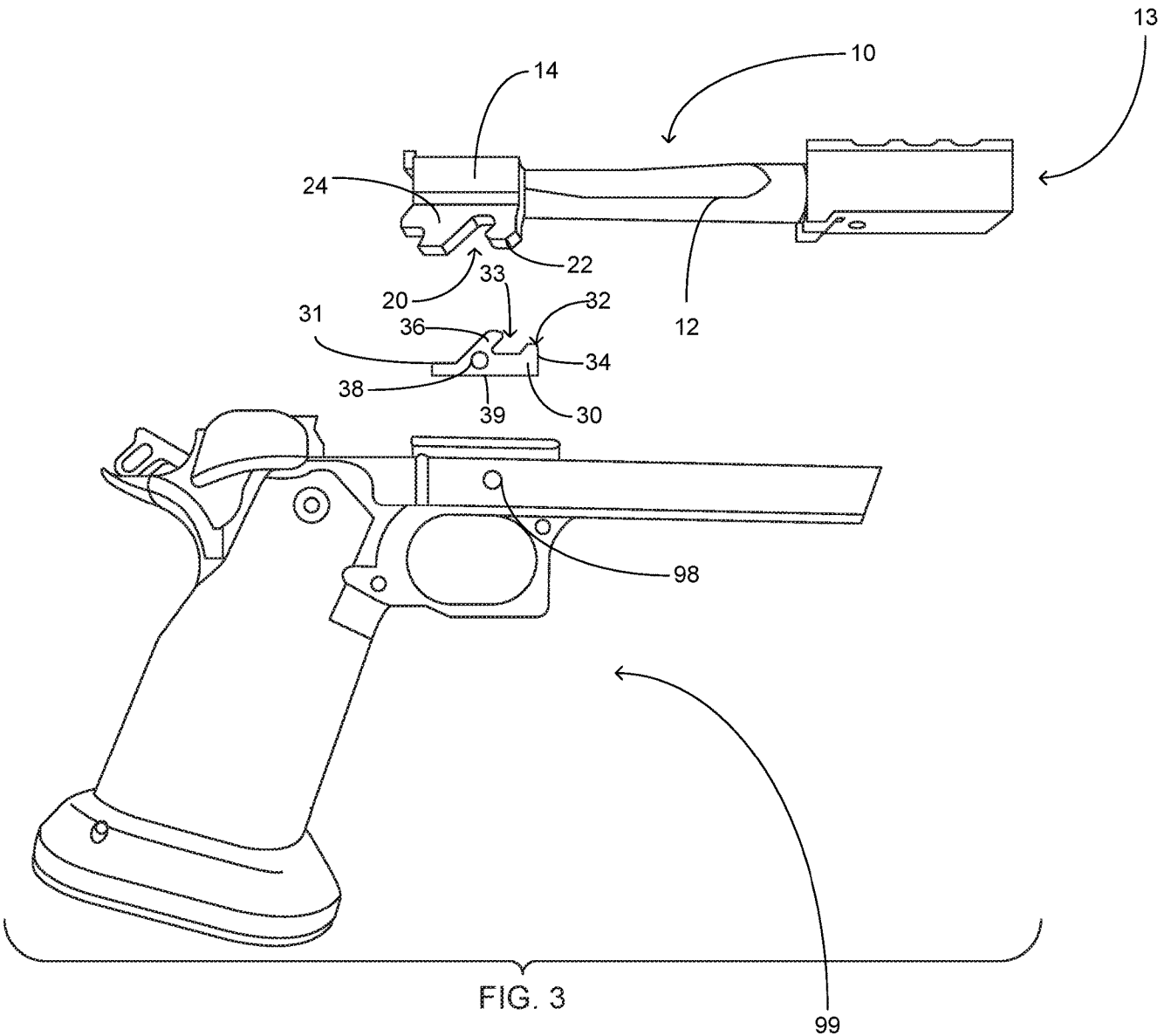
FIG. 3 is disassembled side view of the firearm of the present invention showing the locking block and barrel assembly removed.

The locking block 30 is releasably secured within the void 51 of the receiver 50 as illustrated herein in FIG. 2. It should be noted that the locking block 30 is illustrated slightly forward of its secured position for illustration purposes. The locking block 30 has an upper surface 32 that defines a shape that is mateable with the lower portion 18 of the second portion 14 of the barrel 10. The upper surface 32 includes a valley 33 opposedly bordered by a front rise member 34 and a rear rise member 36 that extend upward. The rear rise member 36 is shaped so as to mateably engage notch 20 with front rise member 34 being forward and adjacent front shoulder 22 upon completed assembly. The aforementioned structure facilitates an operable coupled between the barrel 10 and the receiver 50. It is contemplated within the scope of the present invention that the locking block 30 and the second portion 14 of the barrel 10 could be formed in alternate shapes so as to facilitate the mateable operable coupling of the barrel 10 and the receiver 50.

The locking block 30 includes aperture 38 that will align with aperture 98 so as to receive a pin therethrough in order to releasably secure the locking block 30 within the void 51 of the receiver 50. The single aperture 38 coupled with the use of a pin (not illustrated herein) provides a rapid technique to interchange a barrel 10 with the receiver 50. It is contemplated within the scope of the present invention that the pin configured to be journaled into aperture 38 and aperture 98 be structured so as to be removable and installed without the requirement for tools. While a particular shape of locking block 30 and lower portion 18 of the second portion 14 have been illustrated herein, it is contemplated the alternate mateable shapes could be utilized and achieve the desired functionality as described herein. The locking block 30 includes bottom surface 39 that is flat in manner so as to be superposed the bottom 53 of the void 51 in receiver 50.

Figure 4:
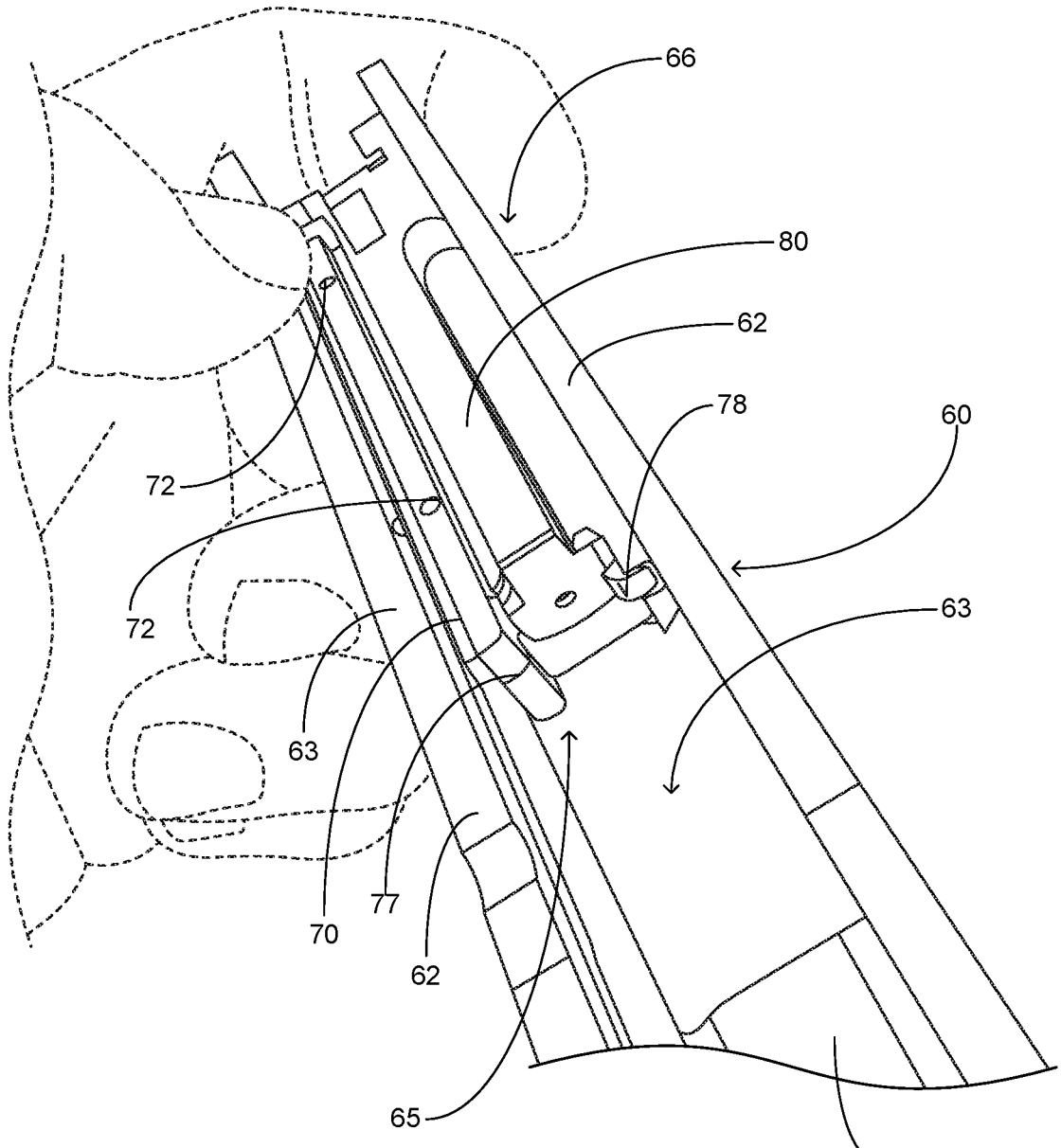
FIG. 4 is a perspective view of the interior of the slide of the present invention.

Referring now to FIG. 4, the slide 60 of the present invention is illustrated therein. Slide 60 is manufactured similar to conventional firearm slides wherein a plurality of walls 62 are integrally formed creating an interior volume 63 that is configured to accommodate a portion of the barrel 10 therein upon assembly of the firearm. An extractor housing 80 is integrally formed utilizing conventional techniques on the rear end 66 of the slide 60. The slide 60 includes void 65 intermediate wall 63 and extractor housing 80 and is configured to have releasably secured therein shim member 70. Conventional firearm slide construction includes a solid wall with and an integrally formed extractor housing to house portions of the extractor. As the intention of the present invention is to provide a construction that will facilitate the rapid changing of a barrel to an alternate caliber with no tooling required, the slide 60 includes void 65. Void 65 is rectangular in shape and is formed to accommodate shim member 70. Shim member 70 is manufactured from a durable rigid material such as but not limited to metal and is secured within the void 65 utilizing pins 72. The shim member 70 is releasably secured and is provided in alternate thicknesses so as to provide the desired functionality for alternate caliber ammunition. The end 77 of the shim member 70 extends beyond the extractor housing 80 wherein end 77 is configured to provide a bias against a ammunition shell casing so as to ensure effective engagement with the extractor pin 72. The end 77 of the shim member 70 functions to bias against a ammunition shell present in the firing chamber so as to ensure efficient engagement with the extractor pin 78 thereby providing proper ejection of a cartridge. By way of example but not limitation, a .45 caliber shell and a .380 caliber shell have alternate diameters. Without employment of the shim member 70, the extractor pin 78 would be unable to effectively engage the ammunition shell and provide proper ejection of both aforementioned calibers. The shim member 70 is provided in alternate thickness wherein a user can insert the shim into the void 65 and have end 77 bias against an ammunition shell adjacent thereto. It should be understood within the scope of the present invention that the shim member 70 could be provided in alternate thicknesses so as to provide effective operation for various caliber ammunition. It should be further understood within the scope of the present invention that the shim member 70 could be mechanically secured utilizing alternate types of fasteners in addition to or in conjunction with the pins 72.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A firearm assembly comprising:

a receiver, said receiving having an interior volume, said receiver having an inner rear wall;

a locking block, said locking block being configured to be disposed within said interior volume of said receiver, said locking block having an upper surface and a lower surface, said locking block having a rear edge wall;

a barrel, said barrel having a first portion and a second portion, said barrel having a front end and a rear end, said second portion being proximate said rear end of said barrel, said first portion and said second portion being integrally formed, said second portion of said barrel having a lower portion, said second portion having a front shoulder and a rear shoulder and further having a notch therebetween, said lower portion of said second portion of said barrel having a lower rear wall, said lower rear wall being axially aligned with said rear edge wall of said locking block; and wherein the upper surface of said locking block and said lower portion of said second portion are formed in a mateable shape so as to facilitate an operable connection between the barrel and the locking block and wherein said lower rear wall of said lower portion of said second portion of said barrel is operable to engage the inner rear wall of said receiver during a firing cycle so as to inhibit further rearward movement of said barrel.

2. The firearm assembly as recited in claim 1, wherein the locking block further includes at least one aperture, said at least one aperture being bored through said locking block, said at least one aperture configured to receive a fastener therethrough so as to secure said locking block within the interior volume of the receiver.

3. The firearm assembly as recited in claim 2, wherein said lower portion of said second portion of said barrel includes at least one notch, said at least one notch configured to mateable engage a portion of the upper surface of said locking block.

4. The firearm assembly as recited in claim 3, wherein said upper surface of said locking block includes at least one rise member, said at least one rise member configured to mateably insert into said at least one notch.

5. The firearm assembly as recited in claim 4, wherein said at least one notch and said at least one rise member are angular in manner.

6. The firearm assembly as recited in claim 5, wherein said notch further includes an indentation proximate a top forward edge thereof.

* * * * *